US010723166B1

(12) United States Patent
Thawornsing

(10) Patent No.: US 10,723,166 B1
(45) Date of Patent: Jul. 28, 2020

(54) SEE-THROUGH HIGHLIGHTER

(71) Applicant: Napat Thawornsing, San Francisco, CA (US)

(72) Inventor: Napat Thawornsing, San Francisco, CA (US)

( * ) Notice: Subject to any disclaimer, the term of this patent is extended or adjusted under 35 U.S.C. 154(b) by 0 days.

(21) Appl. No.: 16/686,076

(22) Filed: Nov. 15, 2019

(51) Int. Cl.

| | |
|---|---|
| ***B43K 5/00*** | (2006.01) |
| ***B43K 5/02*** | (2006.01) |
| ***B43K 1/12*** | (2006.01) |
| ***B43K 29/00*** | (2006.01) |
| ***B43K 8/02*** | (2006.01) |

(52) U.S. Cl.
CPC ..... *B43K 5/005* (2013.01); *B43K 1/12* (2013.01); *B43K 5/02* (2013.01); *B43K 8/02* (2013.01); *B43K 29/00* (2013.01); *B43K 29/003* (2013.01)

(58) Field of Classification Search
CPC . B43K 5/005; B43K 5/02; B43K 1/12; B43K 5/18; B43K 5/1809; B43K 7/005; B43K 8/03; B43K 8/02; B43K 8/026; B43K 29/00; B43K 29/003
See application file for complete search history.

(56) References Cited

U.S. PATENT DOCUMENTS

| | | | | |
|---|---|---|---|---|
| 3,994,605 A * | 11/1976 | McKnight | B43K 7/005 401/99 |
| 4,906,119 A * | 3/1990 | Hartford | B43K 7/005 401/48 |
| 5,527,124 A * | 6/1996 | Kolaric | B43K 5/005 401/109 |
| 5,564,849 A * | 10/1996 | Greer, Jr. | B43K 5/005 40/334 |
| 6,250,828 B1 * | 6/2001 | Liu | B43K 5/005 401/195 |
| 8,684,617 B2 * | 4/2014 | Koyama | B43K 7/005 401/192 |

* cited by examiner

*Primary Examiner* — David J Walczak
(74) *Attorney, Agent, or Firm* — Donald R. Boys; Central Coast Patent Agency LLC

(57) ABSTRACT

A highlighter with a see-through area comprising a housing having a hollow body and an opening, an ink reservoir disposed inside the housing for storing ink, a nib disposed at the opening and an ink feeder disposed inside the housing for transporting ink from the ink reservoir to the nib. The housing further comprises a cut-out section disposed behind the nib to provide the see-through area for a user. The see-through area allows the user to see a section of text before highlighting. Alternatively, a section of the housing behind the nib can be constructed using transparent material such as plastic to provide a see-through area for a user.

15 Claims, 8 Drawing Sheets

SEE-THROUGH HIGHLIGHTER

BACKGROUND OF THE INVENTION

Highlighter is a type of writing instrument that is designed to be used over existing text. The process of applying highlighter over an existing section of text known as "Highlighting". The inks of Highlighters are often made in bright fluorescent colors that would leave a transparent mark over the existing text, thus making the highlighted section more distinct so it can easily draw attention from readers.

Ideally, using a highlighter would require a user to see a section of text before highlighting which the view would normally be blocked by the hand holding the highlighter. In order to overcome this, the user may angle the grip or adjust the view so that they can see the text before highlighting which can be inconvenient for the user. And without such adjustments would cause the section of text to not accurately or straightly be highlighted. This problem may not be a challenge when using other writing instruments such as a pen or pencil since the hand holding the pen or pencil would not be blocking the view between the user and a writing surface.

The current prior art of highlighters that encompasses a feature to solve this issue is Uni® Promark View highlighter and Sharpie® Clear View Highlighter. Both highlighters have the same feature that is to have a portion of a nib made of a clear transparent material to provide a see-through area for a user. This feature provides a very small see-through area and would not be effective when highlighting a large section of text.

Thus, what is needed is a new highlighter that is designed to overcome the shortcomings of all existing versions of highlighters, that would allow a user to be able to easily see an area of text before highlighting.

SUMMARY OF THE INVENTION

According to one embodiment of the invention, a highlighter comprises a housing having a hollow body and an opening, an ink reservoir disposed inside the housing for storing ink, a nib disposed at the opening for distributing ink on a writing surface, an ink feeder disposed inside the housing for transporting ink from the ink reservoir to the nib. The housing further comprises a cut-out section disposed behind the nib to provide a see-through area for a user. Wherein the ink feeder is constructed to conform to the internal space of the housing, thus having its body curved or angled away from the cut-out section of the housing. Alternatively, the housing may comprise a section of its body, behind the nib, made of a clear or transparent material such as plastic to provide a see-through area.

According to an alternative embodiment, a housing of a highlighter comprises a first portion having a hollow body, a second portion having a hollow body and an opening, wherein the second portion connected to the first portion such that the first and the second portions form an angle or a curve, thus creating a see-through area. An ink reservoir is disposed inside the housing for storing ink. A nib is disposed at the opening for distributing ink on a writing surface. An ink feeder is disposed inside the housing for transporting ink from the ink reservoir to the nib. Wherein the ink feeder is made to conform to the internal space of the housing, thus having its body curved or angled due to the curve or angled body of the housing.

BRIEF DESCRIPTION OF THE DRAWING FIGURES

DETAILED DESCRIPTION

In the following description, there are shown and described several embodiments of the invention. It should be realized the disclosed invention is capable of other different embodiments and their details are capable of modification in various, obvious aspects without departing from the spirit and scope of the invention. The drawings and descriptions should be regarded as illustrative in nature and not as restrictive. In some example embodiments, well-known process, well-known device structures, and well-known technologies are not described in detail.

The invention will be described in an illustrative manner, and it is to be understood that the terminology which will be used is intended to be in the nature of words of description rather than of limitation.

First Example Embodiment of the Invention

Figure 1A:
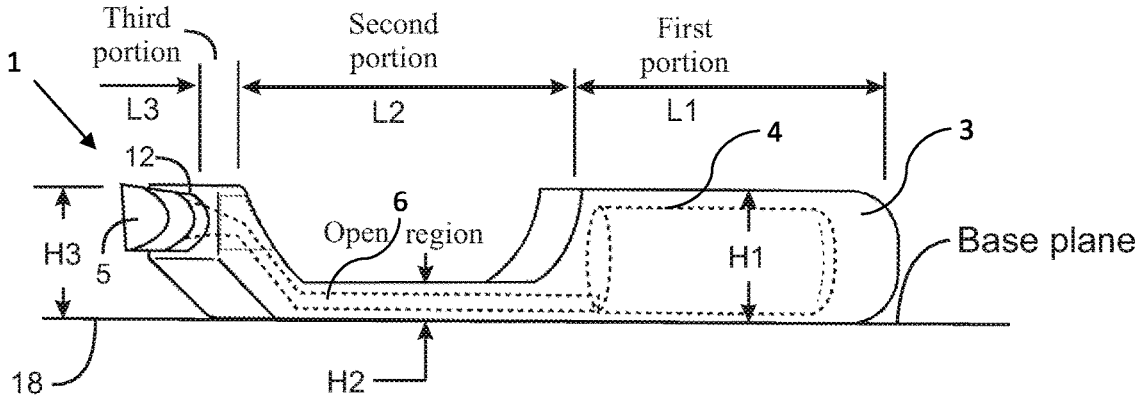
FIG. 1A-1E are drawings of a highlighter and its components according to first example embodiment of the invention.
Figure 1B:
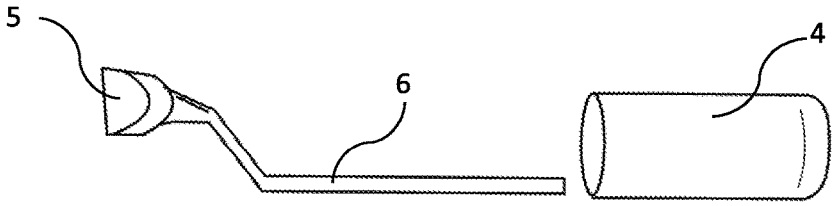
Figure 1C:
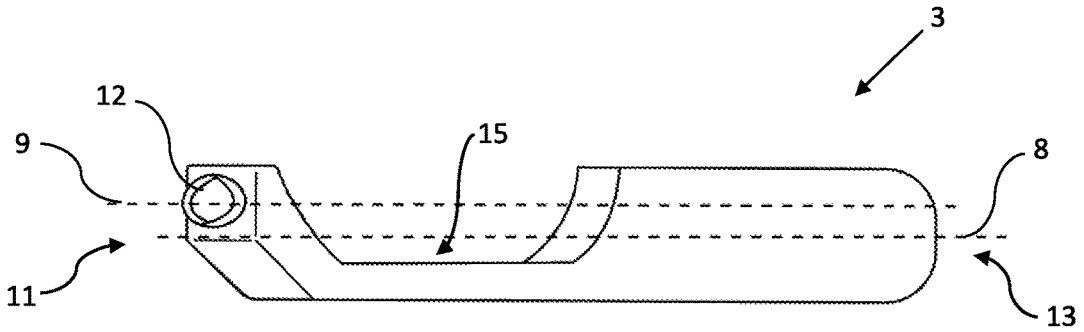
Figure 1D:
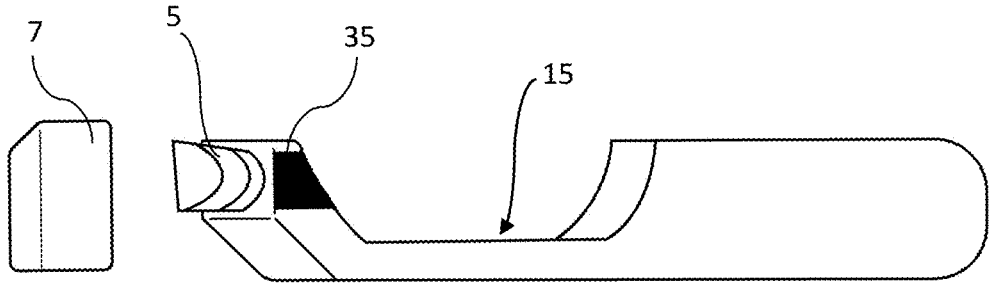
Figure 1E:
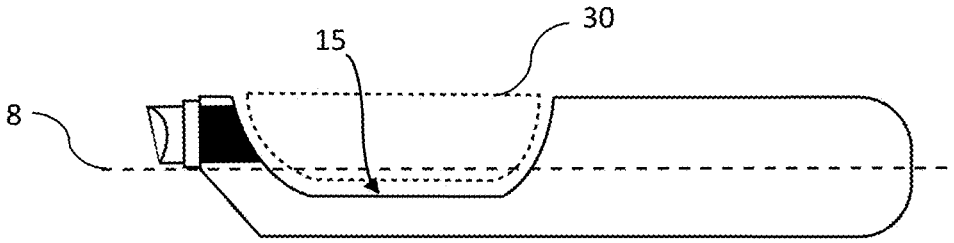

Referring to FIG. 1A-1E, in particular FIG. 1A, a highlighter 1 comprises a housing 3, an ink reservoir 4, a nib 5 and an ink feeder 6. The housing 3 may also be called by other names known in the art, such as "case", "container", "body", "handle", "tube" or "barrel". The housing 3 may have an elongated shape with a hollow body adapted to house the ink reservoir 4, the nib 5 and the ink feeder 6. The housing 3 may comprise a closed end 13 and an open end 11. The open end 11 may comprise an opening 12 constructed to receive the nib 5, thus, may have a bore diameter corresponding to the size and shape of the nib 5. The opening 12 may be conventionally constructed such that it can frictionally hold the nib 5. The opening 12 may be constructed to be off center or displaced away from the housing's longitudinal axis 8, thus being positioned close to one side of the housing 3 rather than being conventionally positioned in the center or at the housing's longitudinal axis 8. The housing 3 may be made of materials known in the art such as plastic, aluminum, wood and the like. In FIG. 1A a base plane 18 is shown from which heights H1, H2 and H3 of a first portion, a second portion and a third portion of the highlighter are illustrated. Lengths L1, L2 and L3 of the first, second and third portions are illustrated as well, and the summed length of L1, L2 and L3 indicate an overall length for the highlighter. An open region between the first and the third portions is indicated also in FIG. 1A.

The housing 3 may be constructed into one single unit by well-known methods such as plastic injection molding. Alternatively, the housing 3 can be constructed from various parts that can be reassembled, by using a snap-fit design, to form a housing unit. It should be understood that any of these methods is not a limitation of the invention.

The housing 3 comprises a cut-out section 15, disposed behind the nib 5, on the nib's longitudinal plane 9, for providing a see-through area 30. The cut-out section 15 is preferably disposed closely behind the nib 5 and preferably having a width greater than the width of the nib 5, or the width or the diameter, of the opening 12. The section of housing 3 between the nib 5 and before the cut-out section 15 is preferably as small as possible to decrease blockage of the view of text being highlighted. The cut-out section 15 may be in any shape and size and may have a length preferably around 0.75 to 2 inches. The shape, size, length and width of the housing 3 and the cut-out section 15 can be varied as appreciated by one skilled in the art. For example, the second width of the second portion may be less than the first width of the first portion. The see-through area 30 allows a user to see an area of text before highlighting It should be understood that the term "cut-out" is used to explain the invention, thus should not be regarded as a manufacturing process. The housing 3 may comprises a cut-out section 15 made by molding plastic into a desired shape, without requiring a cutting process.

The ink reservoir 4, for storing highlighter ink, may have a size and shape that would fit inside the housing 3. The ink reservoir 4 may be made by using an absorbent material known in the art such polyester or may be made by using a compartment made of plastic for storing ink.

The nib 5 is disposed at the opening 12 for distributing ink on a writing surface. The nib 5 may have an elongated shape with a conventional chisel tip and may be made by using an absorbent material such as porous, pressed fibers or felt.

The ink feeder 6 can be a portion of the nib 5, disposed inside the housing 3, connected to the ink reservoir 4, for transporting ink from the ink reservoir 4 to the nib 5. The ink feeder 6 can be made of an absorbent material or using an elongated tube made of plastic, or a combination of both. The ink feeder 6 is constructed to conform to the internal space of the housing 3, thus the ink feeder 6 may comprise a portion of its body angled or curved away from the cut-out section 15 or the nib's longitudinal plane 9.

One skilled in the art would appreciate that the ink feeders 6 can be constructed as a part of the nib 5, or as a part of the ink reservoir 4, or can be constructed as a separate unit, or the ink reservoir 4 and the nib 5 and the ink feeder 6 can be constructed into one single unit. Alternatively, the ink feeder 6 can be made of two or more different materials, or the highlighter 1 may comprise more than one ink feeder units that may be made of different materials.

As used herein, the term "Ink feeder" can refer to a portion of a nib, or a portion of an ink reservoir, or a separate unit, or a combination of different units, or a combination of different materials, that provides transportation of ink from an ink reservoir to a nib. And when the nib, the ink feeder, and the ink reservoir are constructed into one single unit, any section of the unit (combined nib, ink feeder and ink reservoir) disposed inside the housing, can be referred to as an "ink feeder".

The highlighter 1 may comprise a cap 7 to prevent the ink from drying out. The cap 7 may be conventionally constructed to be removably received by the housing 3 at the open end 11 by using conventional methods such as a snap-fit design. Also, the closed end 13 of the housing 3 may be conventionally constructed to removably receive the cap 7 when the highlighter 1 is operative.

Figure 1F:
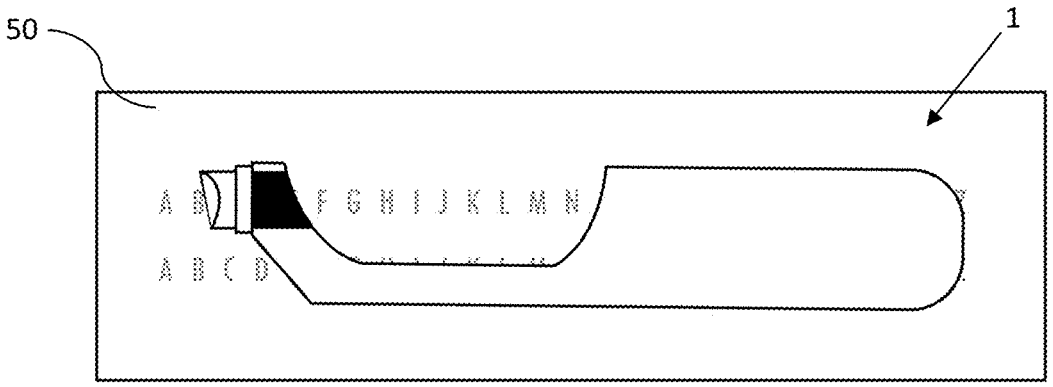
FIG. 1F is a top view of a highlighter, according to the first example embodiment of the invention, placed on paper with written text.

The highlighter 1 may further comprise a nib guide 35 on the housing 3. The nib guide 35 may be a color strip, preferably the same color as the highlighter ink, printed on the housing 3. The nib guide 35 may be disposed on the nib's longitudinal plane 9, behind the nib 5, before the cut-out section 15. The nib guide 35 may have a width equals to the width of the nib 5, thus resembling the highlighting path of the nib 5. The nib guide 35 may allow a user to use it as a guidance for highlighting path when the highlighter 1 is operative. The nib guide 35 may be made in different variation such as an indent or a bump on the housing's surface, or any other preferred masking as appreciated by one skilled in the art, for the purpose of providing guidance of the highlighting path of the nib 5, FIG. 1F is a top view of a highlighter, according to the first embodiment of the invention, placed on paper with written text.

The highlighter 1 is placed over the paper 50 having text written thereon. The cut-out section (not labeled) allows the user to see the text within the see-through area (not labeled).

Second Example Embodiment of the Invention

Referring to FIG. 2A-2E, a highlighter 1 comprises a housing 3, an ink reservoir 4, a nib 5 and an ink feeder 6. The housing 3 may have an elongated shape with a hollow body adapted to house the ink reservoir 4, the nib 5 and the ink feeder 6. The housing 3 may comprise a closed end 13 and an open end 11. The open end 11 may have an opening 12 constructed to receive the nib 5, thus may have a bore diameter corresponding to the size and shape of the nib 5. The opening 12 may be conventionally constructed such that it can frictionally hold the nib 5. The opening 12 may be constructed to be off center or displaced away from the housing's longitudinal axis 8, thus being positioned close to one side of the housing 3 rather than being conventionally positioned in the center or at the housing's longitudinal axis 8. The housing 3 may be made of materials known in the art such as plastic, aluminum, wood and the like.

The housing 3 may be constructed into one single unit by well-known methods such as plastic injection molding. Alternatively, the housing 3 can be constructed from various parts that can be reassembled, by using a snap-fit design, to form a housing unit. It should be understood that any of these methods is not a limitation of the invention.

The housing 3 comprises a see-through section 16, made of a clear transparent plastic, disposed thereto the body of the housing 3. The see-through section 16 is preferably disposed on the nib's longitudinal plane 9, closely behind the nib 5, for providing a see-through area 30. The see-through section 16 preferably has a width greater than the width of the nib 5, or the width or the diameter, of the opening 12. The length of the see-through section 16 may be around 1 to 2 inches or as appreciated by one skilled in the art. The see-through section 16 may be in any shapes and sizes, and can have a hollow or solid body, and can be an integral or separate part as appreciated by one skilled in the art. The see-through area 30 allows a user to see an area of text before highlighting.

The ink reservoir 4, for storing highlighter ink, may have a size and shape that would fit inside the housing 3. The ink reservoir 4 may be made by using an absorbent material known in the art such polyester or may be made by using a compartment made of plastic for storing ink.

The nib 5 is disposed at the opening 12 for distributing ink on a writing surface. The nib 5 may have an elongated shape with a conventional chisel tip and may be made by using an absorbent material such as porous, pressed fibers or felt.

The ink feeder 6 can be a portion of the nib 5, disposed inside the housing 3, connected to the ink reservoir 4, for transporting ink from the ink reservoir 4 to the nib 5. The ink feeder 6 can be made of an absorbent material or using an elongated tube made of plastic, or a combination of both. The ink feeder 6 is preferably disposed outside the see-through area 16 of the housing 3, thus the ink feeder 6 may comprise a portion of its body angled or curved away from the see-through section 16 or the nib's longitudinal plane 9.

One skilled in the art would appreciate that the ink feeders 6 can be constructed as a part of the nib 5, or as a part of the ink reservoir 4, or can be constructed as a separate unit, or the ink reservoir 4 and the nib 5 and the ink feeder 6 can be constructed into one single unit. Alternatively, the ink feeder 6 can be made of two or more different materials, or the highlighter 1 may comprise more than one ink feeder units that may be made of different materials.

The highlighter 1 may comprise a cap 7 to prevent the ink from drying out. The cap 7 may be conventionally constructed to be removably received by the housing 3 at the open end 11 by using conventional methods such as a snap-fit design. Also, the closed end 13 of the housing 3 may be conventionally constructed to removably receive the cap 7 when the highlighter 1 is operative. The highlighter 1 may further comprise a nib guide (not shown) as disclosed in the first example embodiment.

Figure 2A:
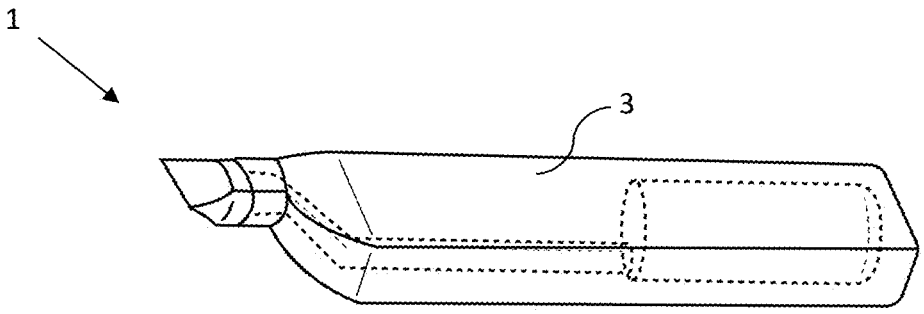
FIG. 2A-2E are drawings of a highlighter and its components according to second example embodiment of the invention.
Figure 2B:
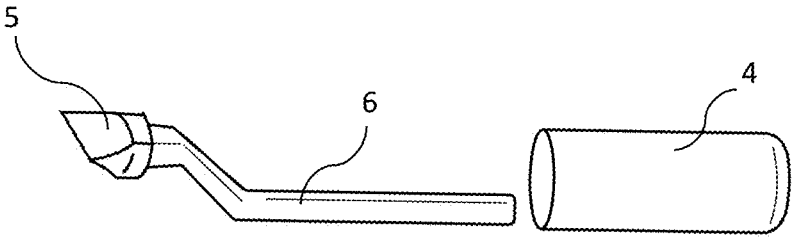
Figure 2C:
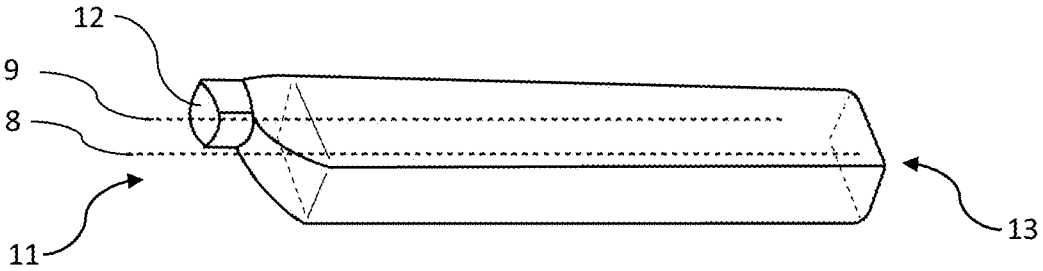
Figure 2D:
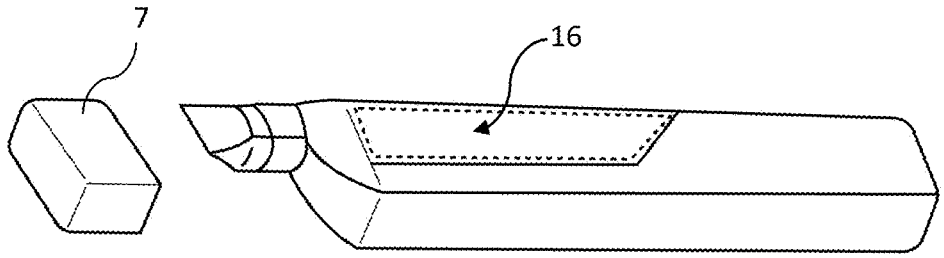
Figure 2E:
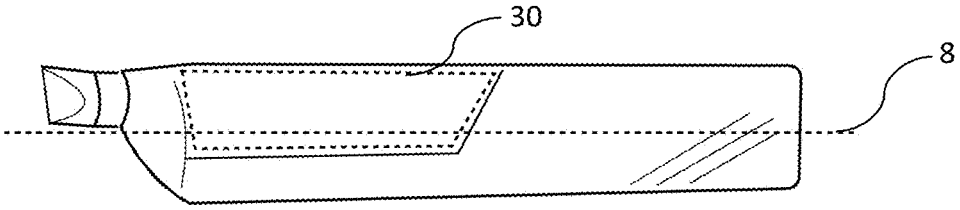
Figure 2F:
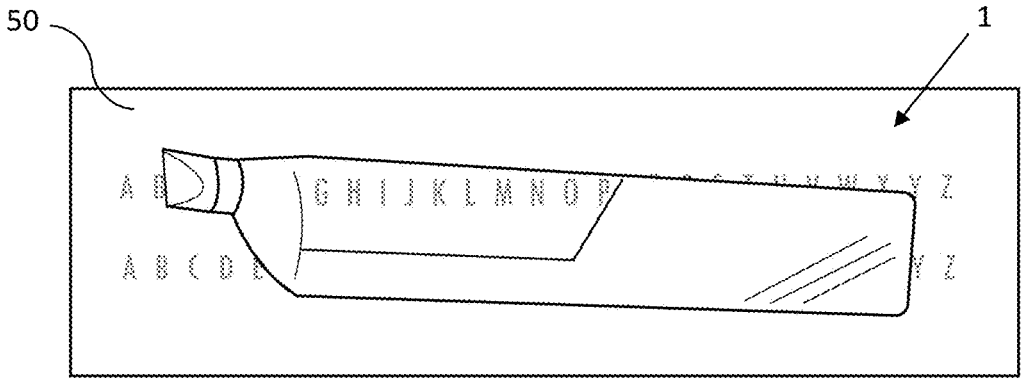
FIG. 2F is a top view of a highlighter, according to the second example embodiment of the invention, placed on paper with written text.

FIG. 2F is a top view of a highlighter, according to the second embodiment of the invention, placed on paper with written text.

The highlighter 1 is placed over the paper 50 having text written thereon. The see-through section (not labeled) allows the user to see the text within the see-through area (not labeled).

Third Example Embodiment of the Invention

Referring to FIG. 3A-3E, a highlighter 1 comprises a housing 3, an ink reservoir 4, a nib 5 and an ink feeder 6. The housing 3 may have an elongated shape with a hollow body adapted to house the ink reservoir 4, the nib 5 and the ink feeder 6. The housing 3 comprises a plane portion 24 and an angled portion 22. The plane portion 24, having a substantial straight body, designed to be the handle of the highlighter 1. The angled portion 22 is extendedly angled away from the plan portion 24 to create a see-through area 30. The see-through area 30 allows a user to see an area of text before highlighting. Alternatively, the angled portion 22 may be constructed to extendedly curved away from the plain portion 24. The housing 3 may comprise a closed end 13 and an open end 11. The open end 11 may comprise an opening 12 disposed on the angled portion 22. The opening 12 may be constructed to receive the nib 5, thus having a bore diameter corresponding to the size and shape of the nib 5. The opening 12 may be conventionally constructed such that it can frictionally hold the nib 5. The housing 3 may be made of materials known in the art such as plastic, aluminum, wood and the like.

The housing 3 may be constructed into one single unit by well-known methods such as plastic injection molding. Alternatively, the housing 3 can be constructed from various parts that can be reassembled, by using a snap-fit design, to form a housing unit. It should be understood that any of these methods is not a limitation of the invention.

Alternatively, an embodiment of the invention may comprise a housing that allows a user to bend or curve or angle a portion of the housing to displace the nib from its original position or the handle's longitudinal plane, thus creating a see-through area. However, such configurations are known to the inventor, so any embodiments that are capable of displacing the nib, either temporarily or permanently, from the handle's longitudinal plane or the nib's original position, to create a see-through area, shall be covered by this disclosure.

The ink reservoir 4, for storing highlighter ink, may have a size and shape that would fit inside the housing 3. The ink reservoir 4 may be made by using an absorbent material known in the art such polyester or may be made by using a compartment made of plastic for storing ink.

The nib 5 is disposed at the opening 12 for distributing ink on a writing surface. The nib 5 may have an elongated shape with a conventional chisel tip and may be made by using an absorbent material such as porous, pressed fibers or felt.

The ink feeder 6 can be a portion of the nib 5, disposed inside the housing 3, connected to the ink reservoir 4, for transporting ink from the ink reservoir 4 to the nib 5. The ink feeder 6 can be made of an absorbent material or using an elongated tube made of plastic, or a combination of both. The ink feeder 6 is constructed to conform to the internal space of the housing 3, thus the ink feeder 6 may comprise a portion of its body angled or curved to conform to the angled or curved body of the housing 3.

One skilled in the art would appreciate that the ink feeders 6 can be constructed as a part of the nib 5, or as a part of the ink reservoir 4, or can be constructed as a separate unit, or the ink reservoir 4 and the nib 5 and the ink feeder 6 can be constructed into one single unit. Alternatively, the ink feeder 6 can be made of two or more different materials, or the highlighter 1 may comprise more than one ink feeder units that may be made of different materials.

The highlighter 1 may comprise a cap 7 to prevent the ink from drying out. The cap 7 may be conventionally constructed to be removably received by the housing 3 at the open end 11 by using conventional methods such as a snap-fit design. Also, the closed end 13 of the housing 3 may be conventionally constructed to removably receive the cap 7 when the highlighter 1 is operative. The highlighter 1 may further comprise a nib guide (not shown) as disclosed in the first example embodiment.

Figure 3A:
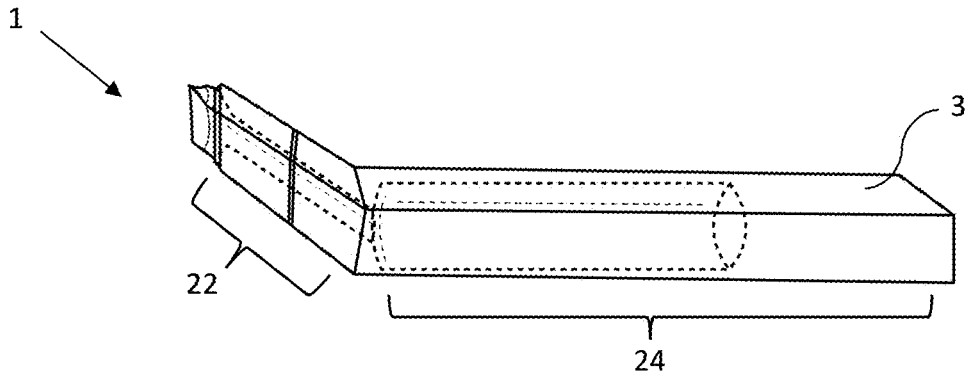
FIG. 3A-3E are drawings of a highlighter and its components according to third example embodiment of the invention.
Figure 3B:
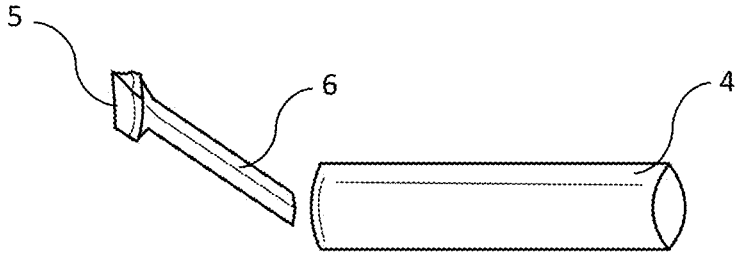
Figure 3C:
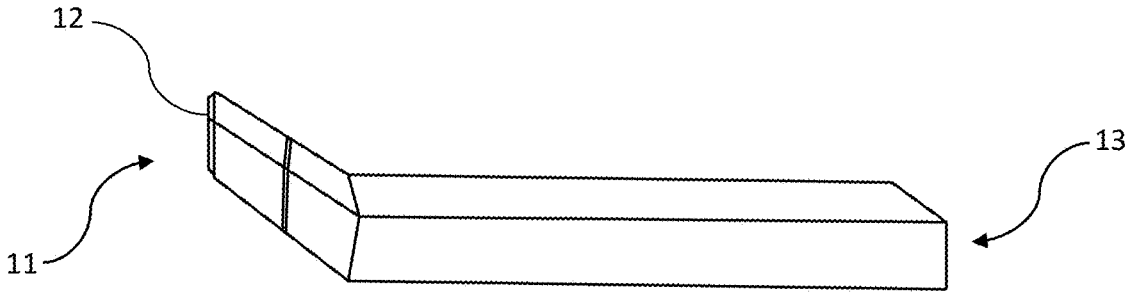
Figure 3D:
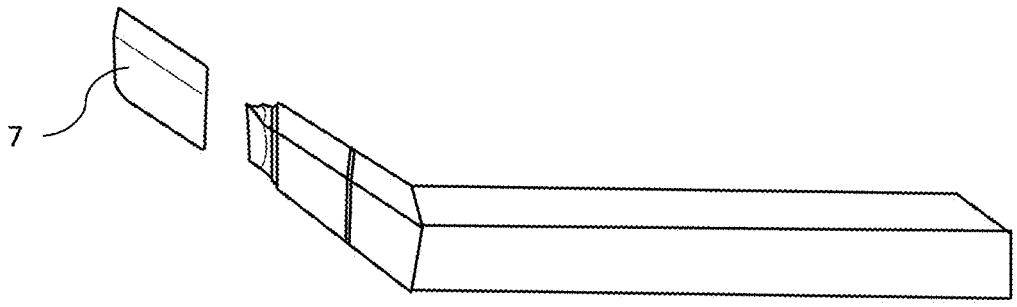
Figure 3E:
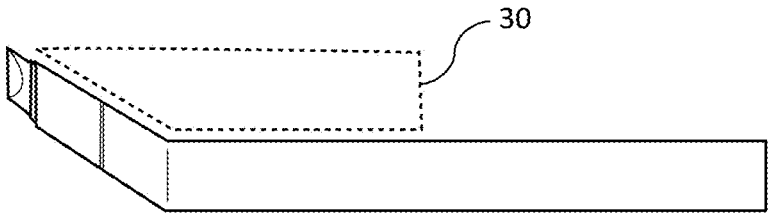
Figure 3F:
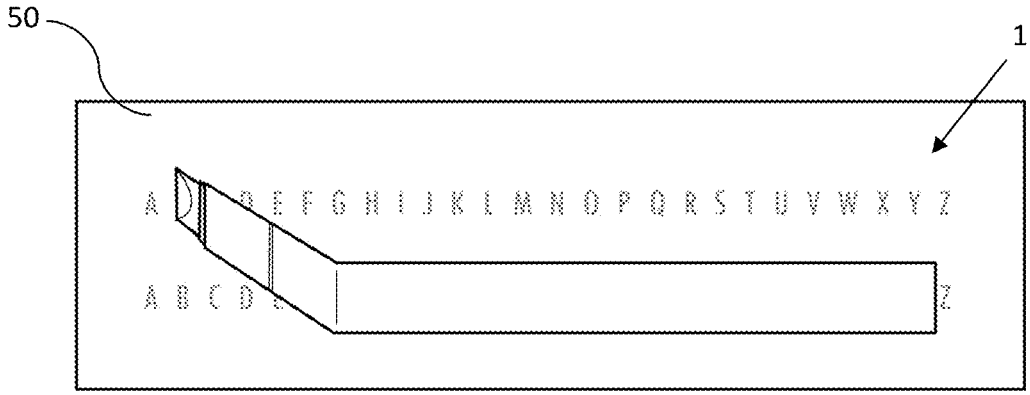
FIG. 3F is a top view of a highlighter, according to the third example embodiment of the invention, placed on paper with written text.

FIG. 3F is a top view of a highlighter, according to the third embodiment of the invention, placed on paper with written text.

The highlighter 1 is placed over the paper 50 having text written thereon. The highlighter 1 allows the user to see the text within the see-through area (not labeled).

Fourth Example Embodiment of the Invention

Referring to FIG. 4A-4E, a highlighter 1 comprises a housing 3, an ink reservoir 4, a nib 5 and an ink feeder 6. The housing 3 may have an elongated shape with a hollow body adapted to house the ink reservoir 4, the nib 5 and the ink feeder 6. The housing 3 may comprise a closed end 13 and an open end 11. The open end 11 may have an opening 12 disposed on the housing's longitudinal axis 8, and may be constructed to receive the nib 5, thus may have a bore diameter corresponding to the size and shape of the nib 5. The opening 12 may be conventionally constructed such that it can frictionally hold the nib 5. The housing 3 may be made of materials known in the art such as plastic, aluminum, wood and the like.

The housing 3 comprises a transparent section 17 disposed thereto the body of the housing 3. The transparent section 17 can be made of a clear transparent material such as plastic for providing a see-through area 30. The transparent section 17 is preferably disposed closely behind the opening 12 and preferably having a length around 1 inch. The transparent section 17 may be in any shapes and sizes, and can have a hollow or solid body appreciated by one skilled in the art. The see-through area 30 allows a user to see an area of text before highlighting.

The ink reservoir 4, for storing highlighter ink, may have a size and shape that would fit inside the housing 3. The ink reservoir 4 is preferably disposed close to the closed end 13, outside the transparent section 17. The ink reservoir 4 may be made by using an absorbent material known in the art such polyester or may be made by using a compartment made of plastic for storing ink.

The nib 5 is disposed at the opening 12 for distributing ink on a writing surface. The nib 5 may have an elongated shape with a conventional chisel tip and may be made by using an absorbent material such as porous, pressed fibers or felt.

The ink feeder 6 can be a part of the nib 5, disposed inside the housing 3, connected to the ink reservoir 4, for transporting ink from the ink reservoir 4 to the nib 5. According to this embodiment, the ink feeder 6 is disposed on the housing's longitudinal axis 8, having a straight body connected to the ink reservoir 4. The ink feeder 6 may be constructed to have an elongated narrow body, preferably having a width smaller than the width of the nib 5 or the width or the diameter of the opening 12, receiving the nib 5. Alternatively, the ink feeder 6 may be constructed to have a width less than a width of a common font size and type such as 12 points Arial, Calibri, Time News Roman etc. when printed on paper. The ink feeder 6 can be made of an absorbent material or constructed using an elongated tube made of plastic, or a combination of both.

One skilled in the art would appreciate that the ink feeders 6 can be constructed as a part of the nib 5, or as a part of the ink reservoir 4, or can be constructed as a separate unit, or the ink reservoir 4 and the nib 5 and the ink feeder 6 can be constructed into one single unit. Alternatively, the ink feeder 6 can be made of two or more different materials, or the highlighter 1 may comprise more than one ink feeder units that may be made of different materials.

The highlighter 1 may comprise a cap 7 to prevent the ink from drying out. The cap 7 may be conventionally constructed to be removably received by the housing 3 at the open end 11 by using conventional methods such as a snap-fit design. Also, the closed end 13 of the housing 3 may be conventionally constructed to removably receive the cap 7 when the highlighter 1 is operative. The highlighter 1 may further comprise a nib guide (not shown) as disclosed in the first example embodiment.

Figure 4A:
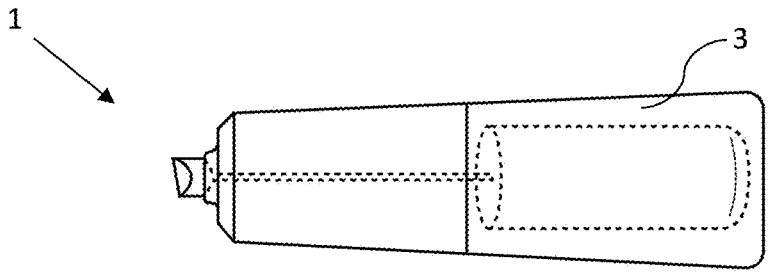
FIG. 4A-4E are drawings of a highlighter and its components according to fourth example embodiment of the invention.
Figure 4B:
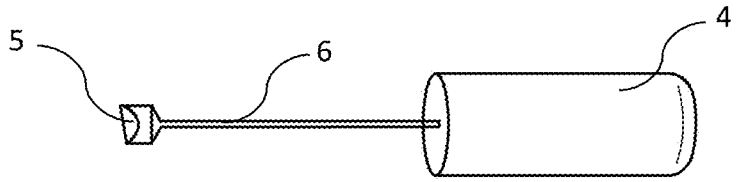
Figure 4C:
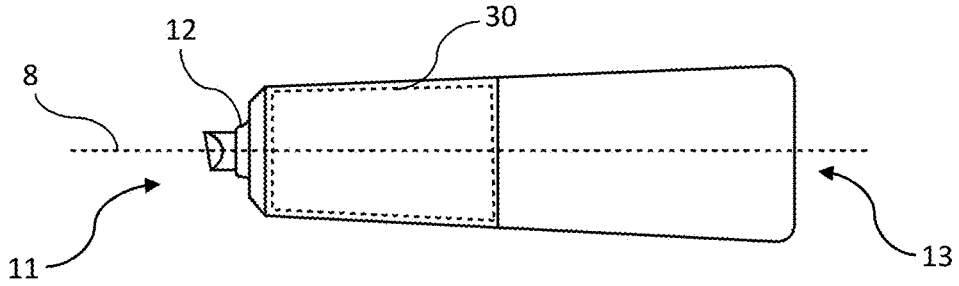
Figure 4D:
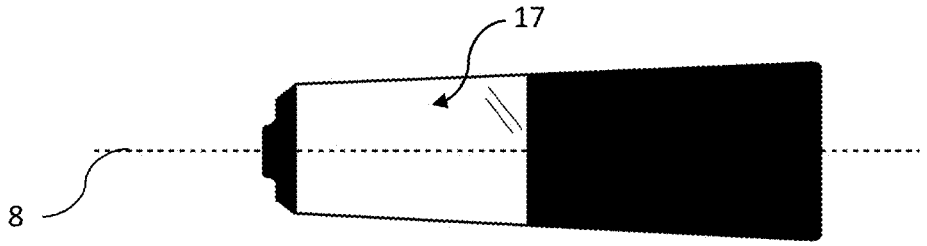
Figure 4E:
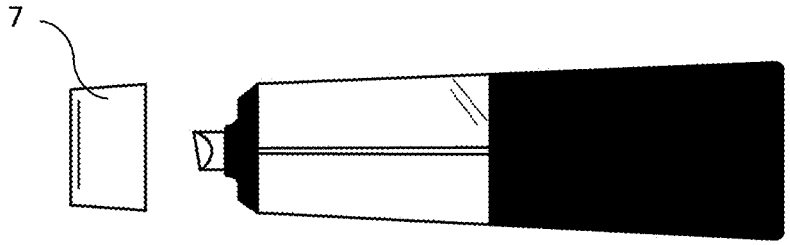
Figure 4F:
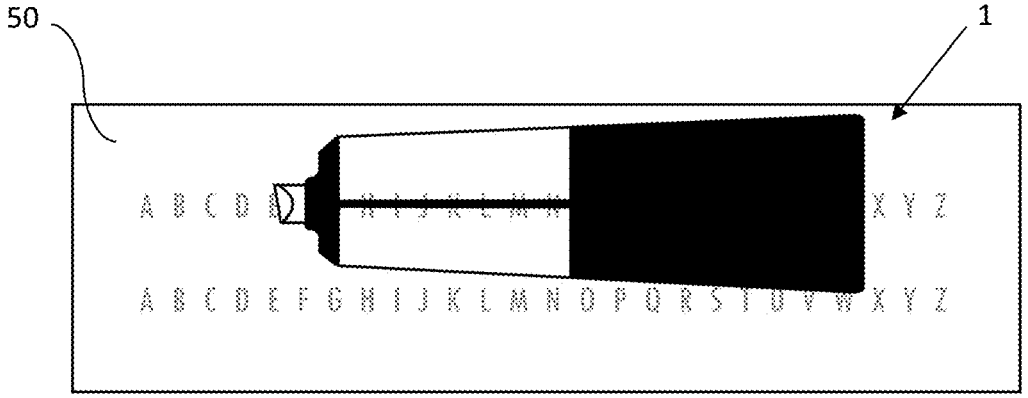
FIG. 4F is a top view of a highlighter, according to the fourth example embodiment of the invention, placed on paper with written text.

FIG. 4F is a top view of a highlighter, according to the second embodiment of the invention, placed on paper with written text.

The highlighter 1 is placed over the paper 50 having text written thereon. The transparent section 17 (not labeled) allows the user to see the text within the see-through area (not labeled).

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

As used herein, the terms "the", "a" or "an" mean "at least one" and should not be limited to "only one". Unless explicitly indicated to the contrary. Thus, for example, reference to "an element" includes embodiments having two or more such elements unless the context clearly indicates otherwise.

What is claimed is:

1. A highlighter, comprising:

a housing having an overall length from a first end to a second end, a width, a base plane, and an overall height, the housing comprising:

a first portion with a first length from the first end having a first height above the base plane;

a second portion with a second length proceeding from the first portion away from the first end, the second portion having a second height above the base plane of a height less than the first height;

a third portion with a third length proceeding from the second portion away from the first end to the second end, the third portion having a third height above the base plane greater than the second height, the housing having an open region between the first portion and the third portion, and a length equal to the length of the second portion;

a nib of porous material extending through an opening at an upper extremity in the third portion in the direction of the length of the housing, the nib having a chisel edge parallel with the height of the housing;

an ink reservoir inside the housing for storing and providing ink to the nib; and an ink feeder connecting the ink reservoir and the nib;

wherein, with a user holding the highlighter by the first portion, with the chisel edge of the nib positioned over a line of text, the line of text is visible to the user through the open region over the second portion of the housing.

2. The highlighter of claim 1, further comprising a nib guide marked or printed on a side of the third portion of the housing from the second end to the second portion, on a side visible to the user while marking text.

3. The highlighter of claim 2 wherein the nib guide is a printed region having a height equal to a diameter of the nib and a centerline common to a centerline of the nib.

4. The highlighter of claim 1 wherein the open region has a length of from three-quarters of an inch to two inches.

5. The highlighter of claim 4 wherein the open region is composed of transparent material, such that a user may see text through the open region.

6. The highlighter of claim 4 wherein the open region is hollow.

7. The highlighter of claim 1 further comprising a curved interface between the portions.

8. A highlighter, comprising:

a housing having an overall length from a first end to a second end and an overall height above a base plane, comprising:

a first portion with a first width and a first length from the first end having a first height above the base plane;

a second portion with a second width and a second length proceeding from the first portion away from the first end, the second portion having a second height above the base plane of a height less than the first height;

a third portion with a third width and a third length proceeding from the second portion away from the first end to the second end, the third portion having a third height above the base plane of a height greater than the second height, the housing having an open region between the first portion and the third portion, the open region having a height from the height of the second portion above the base plane to the overall height of the housing, and a length equal to the length of the second portion;

a nib of porous material extending through an opening in the third portion in the direction of the length of the housing, the nib having a substantially vertically-disposed chisel edge, wherein the chisel edge is entirely above the second height;

an ink reservoir inside the housing for storing and providing ink to the nib; and an ink feeder connecting the ink reservoir and the nib;

wherein, with a user holding the highlighter by the first portion, with the chisel edge of the nib positioned over a line of text, the line of text is visible to the user through the open region over the second portion of the housing.

9. The highlighter of claim 8, wherein the second width of the second portion is less than the first width of the first portion.

10. The highlighter of claim 9, wherein the second length of the second portion is greater than the third length of the third portion.

11. The highlighter of claim 10, wherein the open region has a length of at least a half of an inch.

12. The highlighter of claim 11, further comprising a nib guide marked or printed laterally behind the nib in the third portion of the housing, the nib guide visible to the user while marking text.

13. The highlighter of claim 8, wherein the open region has a length of at least a half of an inch.

14. The highlighter of claim 13, further comprising a nib guide marked or printed laterally behind the nib in the third portion of the housing, the nib guide visible to the user while marking text.

15. The highlighter of claim 14, wherein the open region is entirely above a median longitudinal axis.

* * * * *